US010160222B2

(12) United States Patent
Shiba et al.

(10) Patent No.: US 10,160,222 B2
(45) Date of Patent: Dec. 25, 2018

(54) LIQUID EJECTION APPARATUS, LIQUID CONTAINER, AND MANUFACTURING METHOD THEREOF

(71) Applicant: CANON KABUSHIKI KAISHA, Tokyo (JP)

(72) Inventors: Akira Shiba, Machida (JP); Tsubasa Takaoka, Tokyo (JP); Hiroki Hayashi, Kawasaki (JP); Kazuya Yoshii, Yokohama (JP); Ryo Shimamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/338,031

(22) Filed: Oct. 28, 2016

(65) Prior Publication Data

US 2017/0136776 A1 May 18, 2017

(30) Foreign Application Priority Data

Nov. 17, 2015 (JP) ..... 2015-224951

(51) Int. Cl.
*B41J 2/195* (2006.01)
*B41J 2/175* (2006.01)

(52) U.S. Cl.
CPC .. *B41J 2/17566* (2013.01); *B41J 2002/17576* (2013.01)

(58) Field of Classification Search
None
See application file for complete search history.

(56) References Cited

U.S. PATENT DOCUMENTS

| | | | | |
|---|---|---|---|---|
| 6,270,206 | B1 | 8/2001 | Shimizu et al. | 347/86 |
| 6,325,500 | B1 | 12/2001 | Kitabatake et al. | 347/86 |
| 6,347,865 | B1 | 2/2002 | Matsumoto et al. | 347/86 |
| 6,382,783 | B1 | 5/2002 | Hayashi et al. | 347/85 |
| 6,402,298 | B1 | 6/2002 | Nanjo et al. | 347/49 |
| 6,422,674 | B1 | 7/2002 | Hinami et al. | 347/7 |
| 6,439,705 | B2 | 8/2002 | Eida | 347/85 |
| 6,443,567 | B1 | 9/2002 | Hayashi et al. | 347/85 |
| 6,447,084 | B1 | 9/2002 | Uetsuki et al. | 347/7 |
| 6,450,631 | B1 | 9/2002 | Hayashi et al. | 347/86 |
| 6,471,343 | B1 | 10/2002 | Shimizu et al. | 347/85 |
| 6,474,797 | B2 | 11/2002 | Kurata et al. | 347/85 |

(Continued)

FOREIGN PATENT DOCUMENTS

| | | |
|---|---|---|
| CN | 201851451 | 6/2011 |
| CN | 201916302 | 8/2011 |

(Continued)

OTHER PUBLICATIONS

U.S. Appl. No. 15/272,026, filed Sep. 21, 2016.

(Continued)

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

There are provided a liquid ejection apparatus with low costs, a liquid container, and a manufacturing method thereof. To this end, a rocking body is assembled to the liquid container to suppress the drop thereof by melting and swaging of a support shaft.

11 Claims, 8 Drawing Sheets

(56) References Cited

U.S. PATENT DOCUMENTS

| | | | | |
|---|---|---|---|---|
| 6,485,136 | B1 | 11/2002 | Shimizu et al. | 347/86 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,540,321 | B1 | 4/2003 | Hirano et al. | 347/22 |
| 6,540,342 | B2 | 4/2003 | Koshikawa et al. | 347/86 |
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,629,758 | B2 | 10/2003 | Okamoto et al. | 347/85 |
| 6,637,872 | B2 | 10/2003 | Ara et al. | 347/85 |
| 6,692,115 | B2 | 2/2004 | Sanada et al. | 347/85 |
| 6,698,871 | B1 | 3/2004 | Hayashi et al. | 347/86 |
| 6,709,092 | B2 | 3/2004 | Hayashi et al. | 347/86 |
| 6,719,415 | B1 | 4/2004 | Hattori et al. | 347/86 |
| 6,746,110 | B2 | 6/2004 | Hayashi | 347/86 |
| 6,755,500 | B2 | 6/2004 | Hirano et al. | 347/22 |
| 6,796,645 | B2 | 9/2004 | Hayashi et al. | 347/86 |
| 6,805,434 | B2 | 10/2004 | Hayashi et al. | 347/85 |
| 6,815,381 | B1 | 11/2004 | Yamamoto et al. | 442/187 |
| 6,827,431 | B2 | 12/2004 | Kitabatake et al. | 347/86 |
| 6,851,798 | B2 | 2/2005 | Koshikawa et al. | 347/85 |
| 6,863,762 | B2 | 3/2005 | Sanada et al. | 156/180 |
| 6,877,847 | B2 | 4/2005 | Hayashi et al. | 347/86 |
| 6,942,326 | B2 | 9/2005 | Hayashi et al. | 347/86 |
| 6,966,631 | B2 | 11/2005 | Matsuo et al. | 347/49 |
| 6,997,548 | B2 | 2/2006 | Matsuo et al. | 347/86 |
| 7,118,194 | B2 | 10/2006 | Matsuo et al. | 347/49 |
| 7,134,747 | B2 | 11/2006 | Hayashi et al. | 347/86 |
| 7,165,829 | B2 | 1/2007 | Hayashi et al. | 347/49 |
| 8,011,768 | B2 | 9/2011 | Hayashi et al. | 347/86 |
| 8,439,491 | B2 | 5/2013 | Hayashi et al. | 347/86 |
| 8,485,642 | B2 | 7/2013 | Hayashi et al. | 347/49 |
| 8,529,035 | B2 | 9/2013 | Tsukamoto et al. | 347/86 |
| 8,529,037 | B2 | 9/2013 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 2001/0024224 | A1* | 9/2001 | Eida | B41J 2/17596 347/85 |
| 2003/0038867 | A1 | 2/2003 | Yamamoto et al. | 347/86 |
| 2011/0209335 | A1 | 9/2011 | Yamamoto et al. | 29/505 |
| 2011/0234717 | A1* | 9/2011 | Sakurai | B41J 2/17566 347/86 |
| 2015/0343793 | A1 | 12/2015 | Takada et al. | B41J 2/17556 |
| 2015/0352851 | A1 | 12/2015 | Shiba et al. | B41J 2/17513 |
| 2016/0200113 | A1 | 7/2016 | Nanjo et al. | B41J 2/175 |
| 2016/0200114 | A1 | 7/2016 | Nanjo et al. | B41J 2/17553 |

FOREIGN PATENT DOCUMENTS

| | | | | |
|---|---|---|---|---|
| JP | 2001-248749 | | 9/2001 | |
| JP | 2012-000861 | | 1/2012 | |
| JP | 2012000861 A | * | 1/2012 | B41J 2/175 |
| JP | 2012000861 A | * | 1/2012 | |

OTHER PUBLICATIONS

U.S. Appl. No. 15/274,806, filed Sep. 23, 2016.
U.S. Appl. No. 15/288,879, filed Oct. 7, 2016.
U.S. Appl. No. 15/332,604, filed Oct. 24, 2016.
Office Action dated Jul. 10, 2018 in counterpart Chinese Application No. 2016-11033389.5, together with English translation thereof.

* cited by examiner

LIQUID EJECTION APPARATUS, LIQUID CONTAINER, AND MANUFACTURING METHOD THEREOF

BACKGROUND OF THE INVENTION

Field of the Invention

The present invention relates to a liquid ejection apparatus capable of containing liquid and including a detection unit configured to detect a remaining amount of the liquid, and to a liquid container.

Description of the Related Art

A liquid ejection apparatus includes a supply system that supplies liquid such as ink to a liquid ejection head. In the upstream of the supply system, a liquid container that holds the liquid is detachably attached. Some liquid ejection apparatus includes a detection unit configured to detect a remaining amount of liquid in the liquid container. In the case where the remaining amount of the liquid in the liquid container mounted in the liquid ejection apparatus is small, the fact is detected and the liquid container is exchanged to a new one, thereby allowing continuous use of the liquid ejection apparatus.

Japanese Patent Laid-Open No. 2012-000861 discloses a liquid container that includes a rocking member (rocking body) that rocks around a support shaft depending on a remaining amount of liquid in the liquid container and detects the remaining amount of the liquid, based on a position of the rocking body.

SUMMARY OF THE INVENTION

The present invention is a liquid ejection apparatus that ejects liquid contained in a liquid container and can mount the liquid container capable of containing liquid and having a rocking body rotatable around a support shaft depending on an amount of contained liquid, wherein the rocking body is assembled to the liquid container by melting of a part of the support shaft.

Further features of the present invention will become apparent from the following description of exemplary embodiments (with reference to the attached drawings).

DESCRIPTION OF THE EMBODIMENTS

In order to reliably catch the change in liquid surface in a liquid container and detect the change in remaining amount of the liquid, it is necessary to support a rocking body without disturbing the motion of the rocking body. With a configuration disclosed in Japanese Patent Laid-Open No. 2012-000861, after a support shaft is passed through a shaft hole of the rocking body, a cap member is fit onto the support shaft, thereby suppressing the drop of the rocking body without disturbing the operation of the rocking body.

First Embodiment

However, with the configuration disclosed in Japanese Patent Laid-Open No. 2012-000861, the cap member is required to suppress the drop of the rocking body and there is a problem of an increase in costs due to an increase in the number of parts.

Therefore, according to the present invention, there are provided a liquid ejection apparatus with low costs, a liquid container, and a manufacturing method thereof.

Hereinbelow, a description will be given of a first embodiment of the present invention with reference to the drawings.

Figure 1:
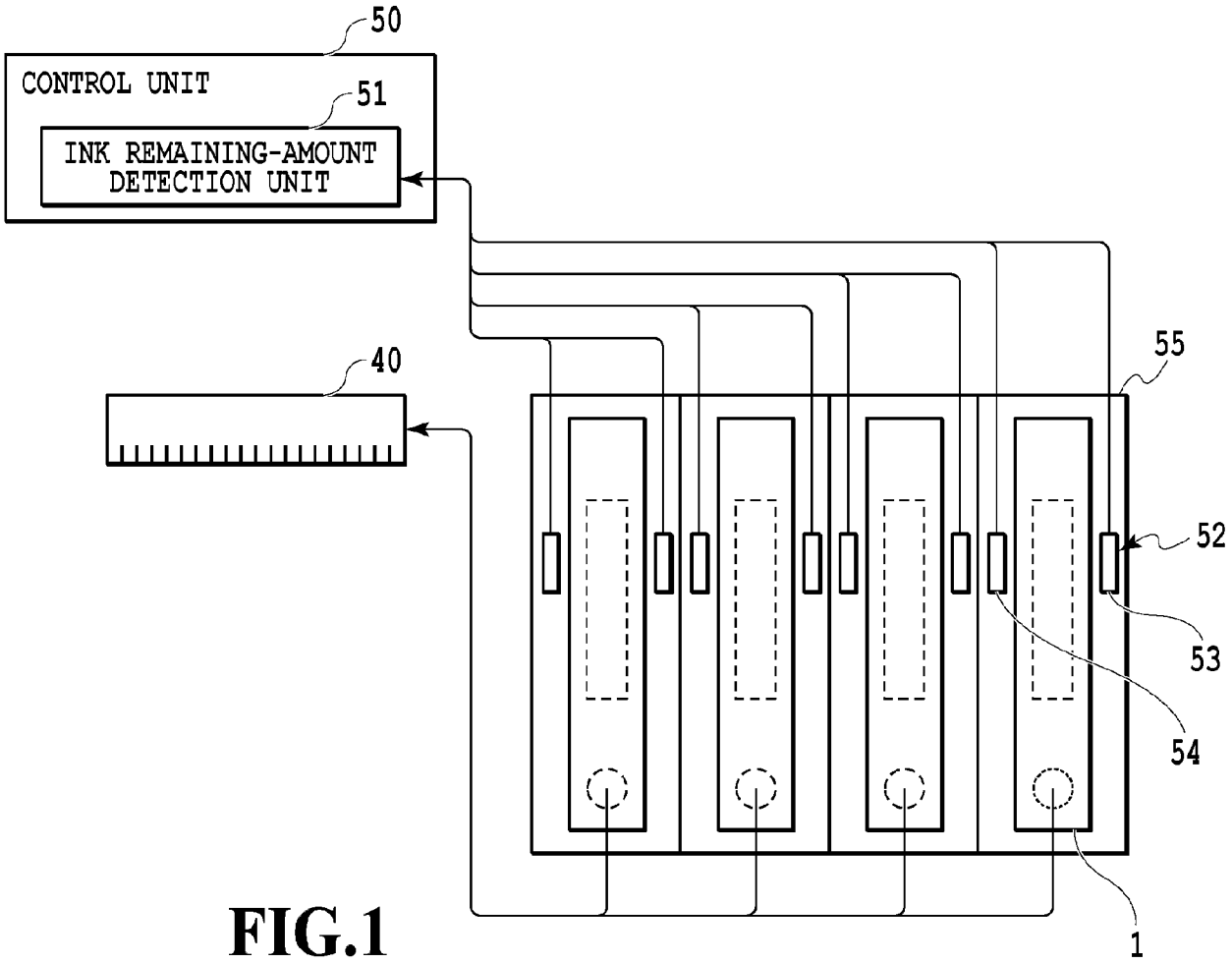
FIG. 1 is a schematic diagram showing a main portion of a liquid ejection apparatus.

FIG. 1 is a schematic diagram showing a main portion of a liquid ejection apparatus to which the present embodiment can be applied. The liquid ejection apparatus includes: an ejection head 40 that ejects liquid; a plurality of detachable liquid containers 1 that is connected to the ejection head 40; and a control unit 50 that controls the ejection of the liquid from the ejection head 40. Further, the control unit 50 includes a liquid remaining-amount detection unit 51 that can detect a remaining amount of liquid in the liquid container 1 based on information from a sensor 52 provided in a container mounting unit 55 to which the liquid container 1 is mounted.

The ejection head 40 is connected to the liquid container 1 with a soft tubular member. The ejection head 40 ejects liquid supplied from the liquid container 1 based on information from the control unit 50. The sensor 52 includes a light reception unit 53 and a light emission unit 54. The light reception unit 53 receives light emitted by the light emission unit 54 and sends a signal to the liquid remaining-amount detection unit 51.

Figure 2:
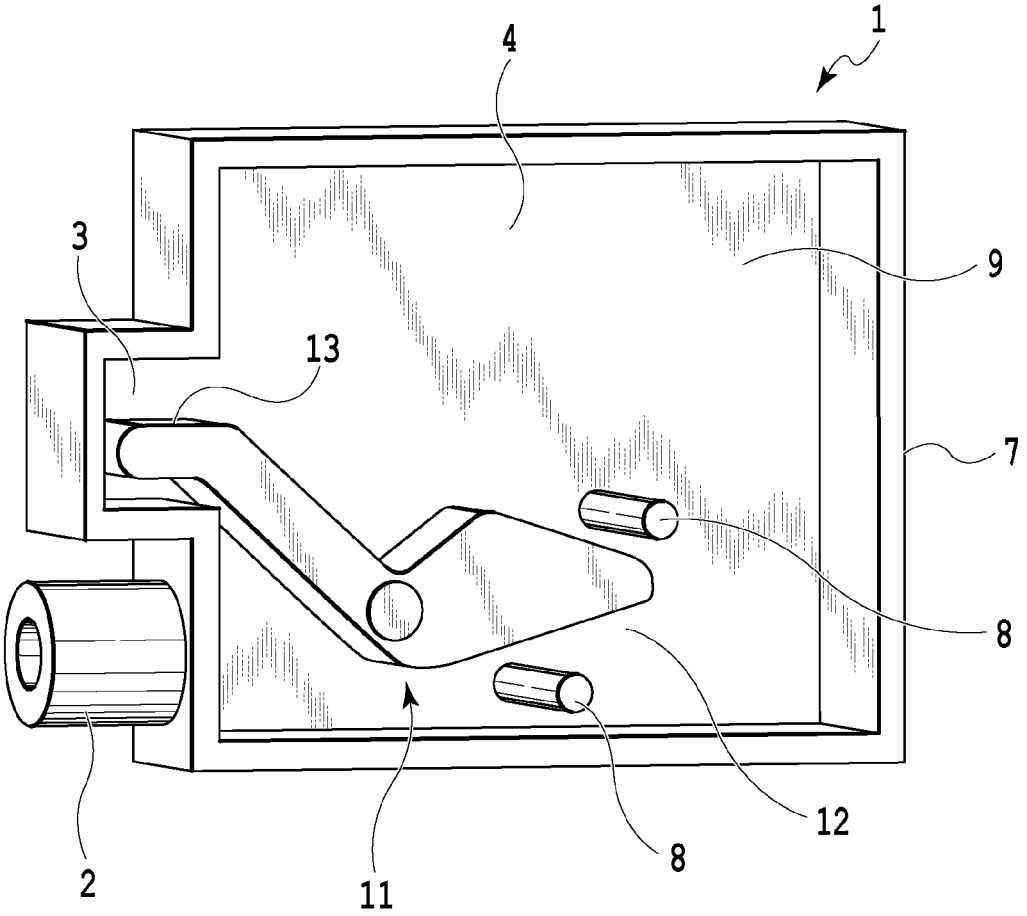
FIG. 2 is a perspective view showing a liquid container that can be mounted in the liquid ejection apparatus.
Figure 3:
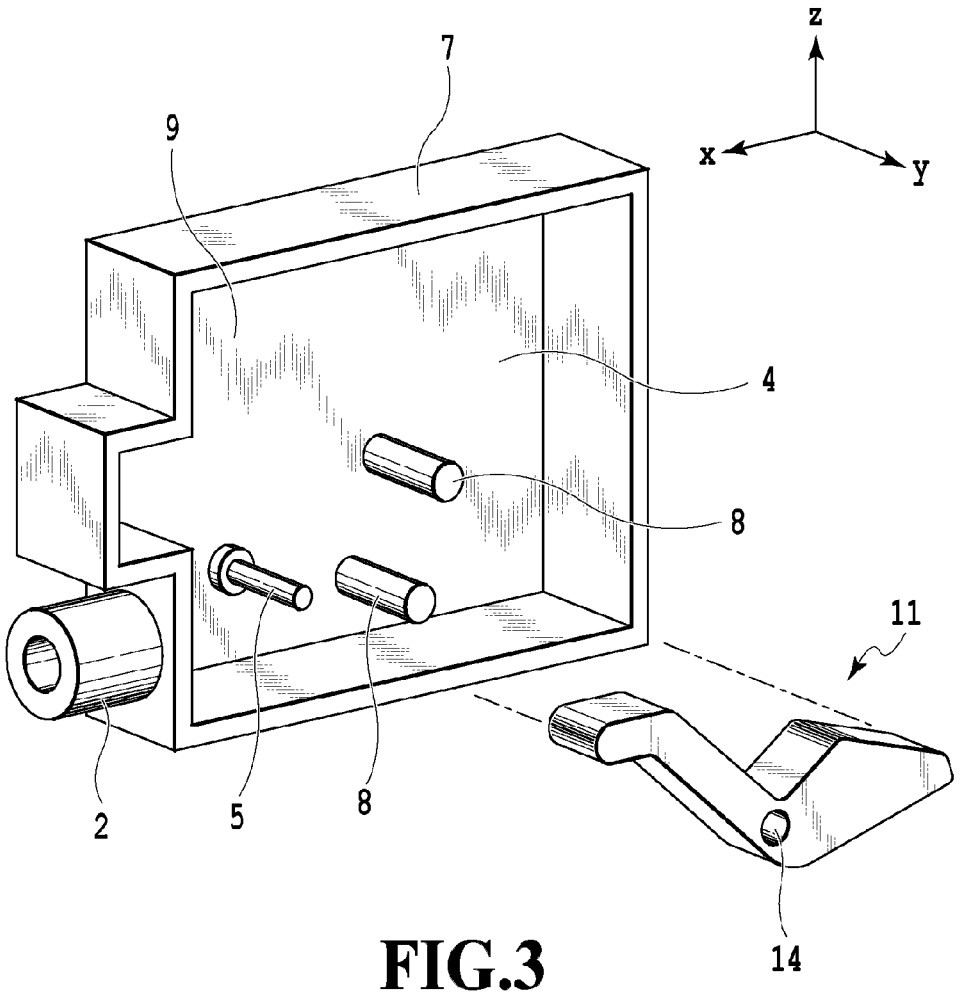
FIG. 3 is an exploded perspective view of the liquid container.

FIG. 2 is a perspective view showing the liquid container 1 mountable in the liquid ejection apparatus. FIG. 3 is an exploded perspective view of the liquid container 1. The liquid container 1 has a rectangular-parallelepiped outer shape in which a length in a width direction (arrow y direction) is small and each of a length in a height direction (arrow z direction) and a length of a depth direction (arrow x direction) is longer than the length in the width direction. The width direction, the height direction, and the depth direction are perpendicular to each other, and a main body frame 7 is formed along the directions.

In the liquid container 1, a part of a portion storing liquid is formed of a flexible film. The main body frame 7 includes a side surface 9 that is widened in a depth direction and a height direction. Another side surface facing the side surface 9 is covered with a film, thereby forming a liquid storage chamber 4 that can store (contain) the liquid inside the main body frame 7. Further, the liquid container 1 includes a remaining-amount detection chamber 3 that is formed by communication with the liquid storage chamber 4 and by projection of the main body frame 7 and a supply port 2 that can supply the liquid in the liquid storage chamber 4 to the outside of the liquid container 1.

The liquid container 1 includes a support shaft 5 and a support post 8 that are vertically provided with respect to the side surface 9, and further includes a rocking body 11 that rotates (rotatable) around the support shaft 5. The rocking body 11 includes a float unit 12 and a detection unit 13. In the case of rotating the rocking body 11, the movement of the float unit 12 is regulated (limited) with the support post 8. Further, it is so configured that by rotation of the rocking body 11, the detection unit 13 moves in the remaining-amount detection chamber 3, corresponding to the position of the float unit 12. In the case where there is sufficient liquid in the liquid storage chamber 4, the float unit 12 rises with buoyant force of the liquid and is located above in the height direction (arrow z direction).

In this case, the detection unit 13 is configured to be located at the lowest position of the remaining-amount detection chamber 3, between the light reception unit 53 and the light emission unit 54 of the sensor 52. That is, in the case where there is sufficient liquid in the liquid storage chamber 4, light of the sensor 52 is blocked with the detection unit 13, and the liquid remaining-amount detection unit 51 does not receive a signal from the sensor 52. In the case of consuming the liquid in the liquid storage chamber 4, the liquid surface of the liquid in the liquid storage chamber 4 gradually lowers, and the position of the float unit 12 thus gradually lowers, and the position of the detection unit 13 gradually rises.

In the case where the remaining amount of the liquid in the liquid storage chamber 4 is extremely small, the float unit 12 is located at the lowest position and the detection unit 13 is located at the highest position and reaches a position where the light from the sensor 52 is not blocked. At this time, the liquid remaining-amount detection unit 51 receives a signal from the sensor 52, there is not the liquid in the liquid container 1 and the liquid remaining-amount detection unit 51 recognizes an exchange timing. As mentioned above, it is so configured that ON/OFF operation of the sensor 52 is performed depending on the position of the detection unit 13, and the remaining amount of the liquid in the liquid container 1 is detected (detectable).

Note that, according to the present embodiment, the description is given of the example of using an optical sensor as the sensor 52. However, the present invention is not limited to this, and may use another system (e.g., magnetic sensor). In the case of the magnetic sensor, the detection unit 13 needs to include a magnetic body.

As mentioned above, the rocking body 11 rocks in accordance with the change in the remaining amount of liquid in the liquid storage chamber 4, and it is necessary to allow rocking of the rocking body 11 and suppress the drop thereof in a state in which the support shaft 5 is passed through a support shaft through-hole of the rocking body 11. According to the present embodiment, the following method realizes a configuration in which the rocking body 11 can rock and does not drop.

Figure 4:
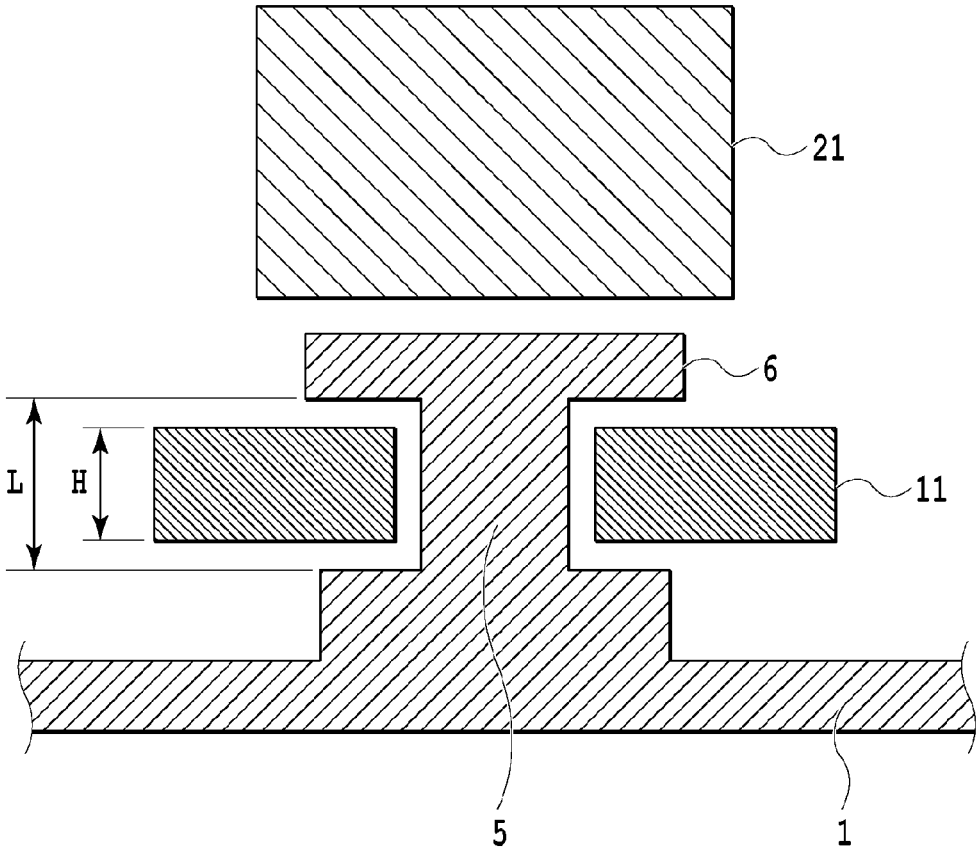
FIG. 4 is a cross-sectional view showing a state in which a support shaft and a rocking body are combined.

FIG. 4 is a cross-sectional view showing a state in which the support shaft 5 and the rocking body 11 are combined. According to the present embodiment, in the case of assembling the rocking body 11, the support shaft 5 is passed through the through-hole provided in the rocking body 11. Thereafter, the tip end portion of the support shaft 5 having passed through the through-hole is swaged and a stop portion 6 is formed with an area wider than an opening area of the through-hole, thereby suppressing the drop of the rocking body 11. That is, the rocking body 11 is assembled to the liquid container by melting of the tip end portion as a part of the support shaft 5. Swaging by the melting of the tip end portion of the support shaft 5 is performed by use of a method for heating a metallic block 21 by using a constant heater or an impulse heater and pressing the metallic block 21 to the tip end portion of the support shaft 5 or a method for generating friction heat due to an ultrasonic welding machine or a twist oscillation welding machine at the tip end portion of the support shaft 5.

As a state after the swaging, clearance is provided to some degree among the main body frame 7, the stop portion 6, and the rocking body 11, and thus the motion of the rocking body 11 is required not to be disturbed as much as possible. To this end, the swaging is performed so that a length dimension L of the support shaft 5 is longer than a thickness dimension H of the rocking body 11. As such a swaging method that the motion of the rocking body 11 is unlikely to be disturbed, there is a method for controlling a swaging amount. The control of the swaging amount includes control of reach height of a welding tool for descending a welding tool such as the metallic block 21 to a constant height from a reference position for fixing the main body frame 7 in the height direction and control of a displacement amount for detecting the tip end position of the support shaft 5 and descending the welding tool by a constant amount with a detection position as a reference. Further, such swaging control is possible that the clearance is provided among the main body frame, the swaging portion, and the rocking body by keeping a given amount of energy to be constant with the tip end position of the support shaft 5 as a reference.

As mentioned above, with melting and swaging of the support shaft, the rocking body is assembled to the liquid container, thereby suppressing the drop thereof. Thus, the liquid container can be manufactured with low costs.

Note that, it is preferable that the length of the support shaft 5 is longer and the height of the stop portion 6 after the swaging is higher than that of a frame portion of the liquid container 1 and, in the case of welding the film for sealing the liquid storage chamber 4, the end of the support shaft is simultaneously welded to the film. Thus, it is possible to suppress the flattering and the deflection of the film.

Further, in the case where the sealing member is a member harder than the film such as a resin plate, the length of the stop portion 6 is lower than the height of the frame portion, and thereby it can be configured such that the assembling of the resin plate or the like is unlikely to be disturbed.

Second Embodiment

Hereinbelow, a description is given of a second embodiment of the present invention with reference to the drawings. Note that, since the basic configuration of the present embodiment is similar to that of the first embodiment, only a characteristic configuration is described in the present embodiment hereinbelow.

Figure 5:
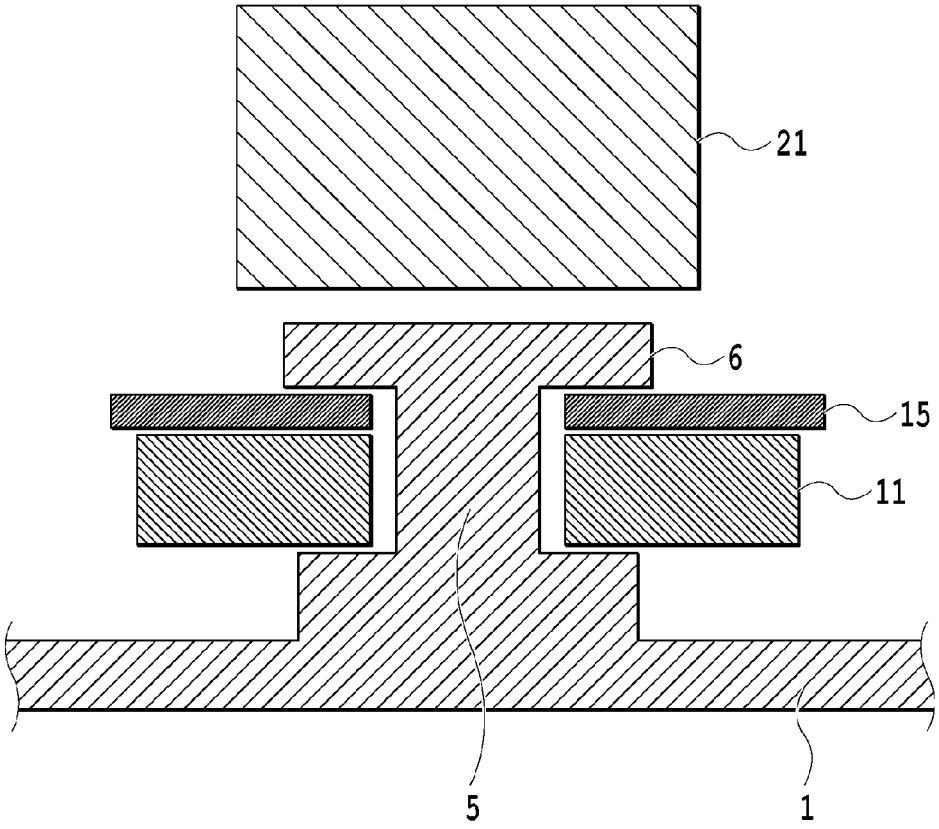
FIG. 5 is a cross-sectional view showing a state in which the support shaft and the rocking body are combined.

FIG. 5 is a cross-sectional view showing a state in which the support shaft 5 and the rocking body 11 are combined in the present embodiment. In the present embodiment, in the case of assembling the rocking body 11, the support shaft 5 is passed through a through-hole provided in the rocking body 11. Thereafter, the support shaft 5 is passed through a hole of a spacer 15 with a predetermined width, and a tip end portion of the support shaft 5 is swaged, thereby forming a stop portion 6 with an area wider than that of the through-hole. After the formation of the stop portion 6, the spacer 15 is removed. The above-formed stop portion 6 suppresses the drop thereof so as not to disturb the operation of the rocking body 11.

In the present embodiment, in the case of swaging with a swaging tool such as a metallic block, a position where the formed stop portion 6 reaches the spacer is a reference of the end, and the swaging is possible in a state in which influence of tolerance of parts such as thickness of a main body frame, the length of the support shaft, and thickness of the rocking body is unlikely to receive. A material such as metal is used for the spacer 15 so as not to be melted with the support shaft 5 or the rocking body 11. Here, the material of the spacer is not limited to metal and resin or the like may be used which has been subjected to surface treatment so as not to be welded.

Figure 6A:
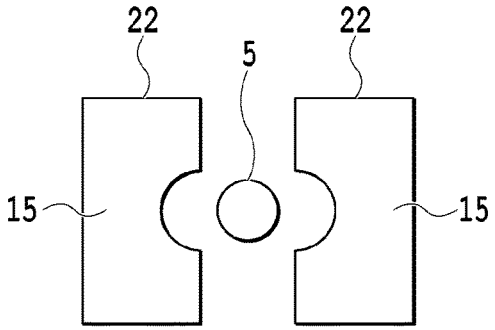
FIG. 6A is a diagram showing a spacer.
Figure 6B:
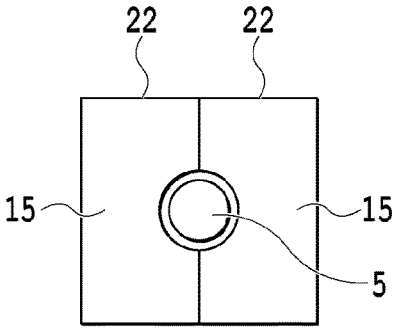
FIG. 6B is a diagram showing the spacer.
Figure 6C:
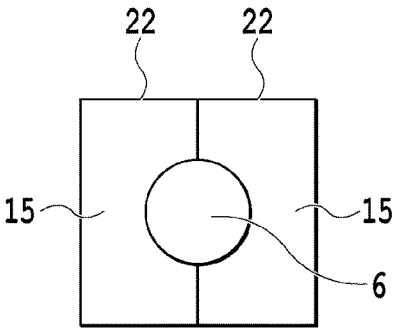
FIG. 6C is a diagram showing the spacer.
Figure 6D:
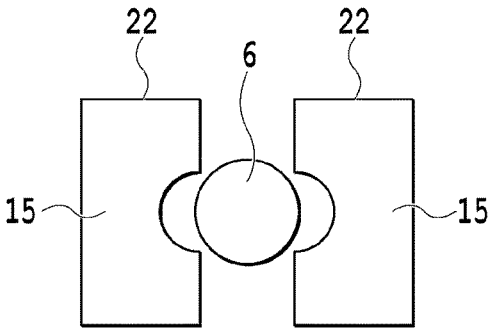
FIG. 6D is a diagram showing the spacer.

FIGS. 6A to 6D are diagrams showing the spacer 15. As shown in FIG. 6A, the spacer 15 is divided into two parts. The parts are set to cover the circumference of the support shaft 5 as shown in FIG. 6B and swaging is performed. After completion of the swaging as shown in FIG. 6C, the spacer 15 is detached as shown in FIG. 6D. Here, the division of the spacer 15 is not limited to the two-division, and may be plural-division.

The spacer 15 can be inserted between the main body frame 7 and the rocking body 11. In the case where the side of a swaging surface of the rocking body 11 is an end reference, the rocking body 11 is also melted in swaging the support shaft 5. In this case, the materials of the support shaft 5 and the rocking body 11 are combination of materials having a melting point of the support shaft 5 lower than that of the rocking body 11, thereby suppressing the welding of the rocking body 11. For example, in the case where the material of the main body frame 7 to which the support shaft 5 is formed is a polyethylene (PE) material and the material of the rocking body 11 is polypropylene (PP) material, the melting point of the PE material is lower than that of the PP material, and therefore it is possible to melt and swage only the support shaft 5 without melting the rocking body 11.

Other Embodiments

Figure 7:
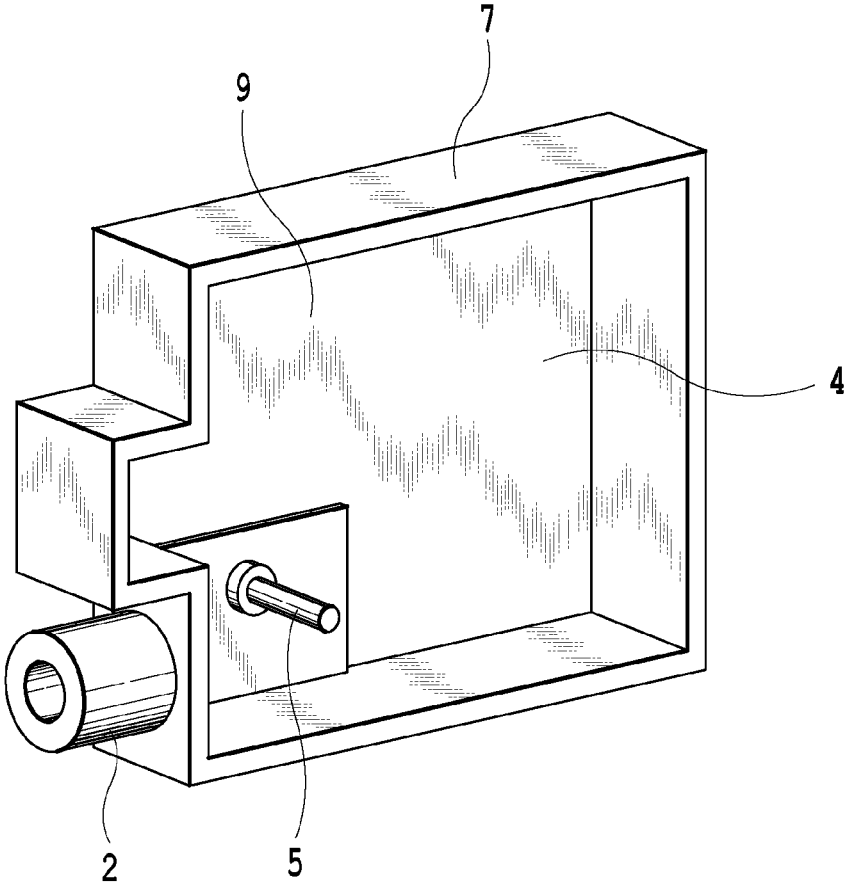
FIG. 7 is a diagram showing another embodiment.
Figure 8A:
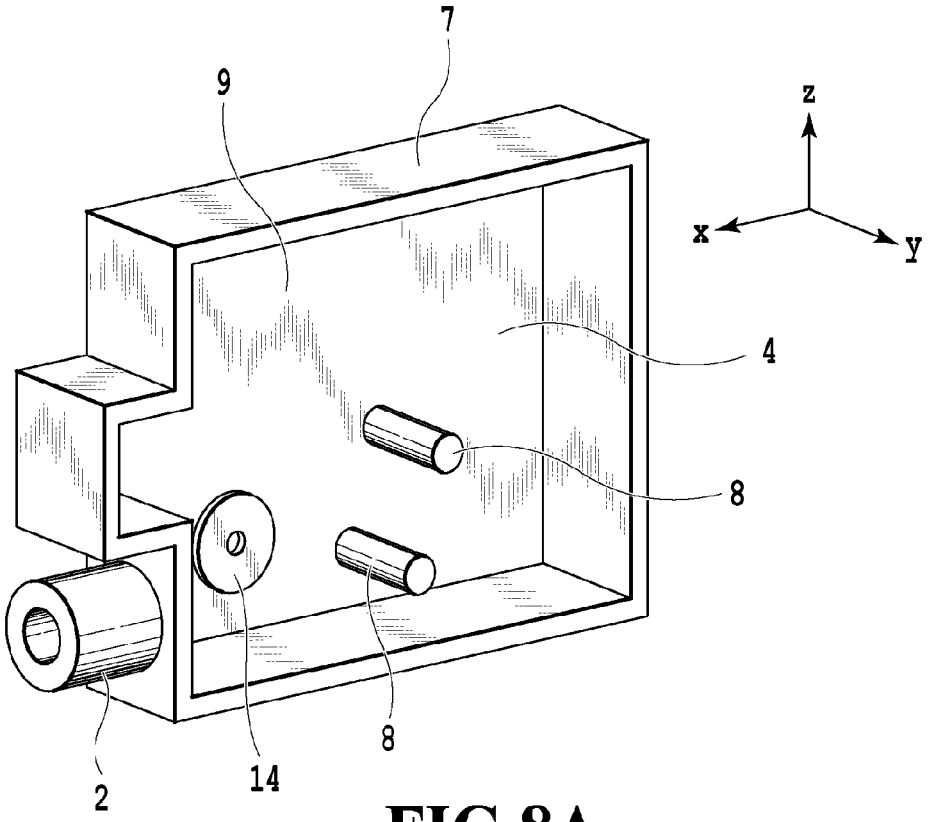
FIG. 8A is a diagram showing another embodiment.
Figure 8B:
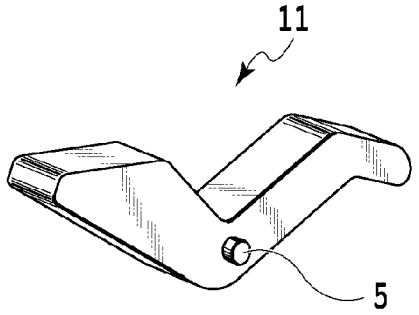
FIG. 8B is a diagram showing another embodiment.

FIGS. 7, 8A, and 8B are diagrams showing other embodiments of the present invention. In the above described embodiments, the description is given of a form of forming the liquid storage chamber 4 by forming the one side of the main body frame 7 by molding and by attaching the film or the like to the other side. However, the present invention is not limited to this. As shown in FIG. 7, the present invention can be applied to a main body frame in a form of forming both the sides with a film or the like without forming a wall surface by molding except for the circumference of the support shaft 5.

Further, a relationship between the support shaft of the main body frame and the support shaft through-hole of the rocking body can be embodied also in a configuration in which the support shaft is provided in the rocking body and the support shaft through-hole is formed in the main body frame as shown in FIG. 8B. In this case, preferably, the support shaft formed in the rocking body is swaged from an outer surface of the main body frame and a swaging portion is covered with a film or the like, thereby suppressing the leakage of the liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-224951 filed Nov. 17, 2015, which is hereby incorporated by reference wherein in its entirety.

What is claimed is:

1. A manufacturing method of a liquid container capable of containing liquid and including a rocking body rotatable around a support shaft depending on an amount of contained liquid, the manufacturing method comprising the steps of:

setting a spacer having a predetermined width at the support shaft;

assembling the rocking body to the liquid container by melting and swaging a part of the support shaft, said assembling of the rocking body to the liquid container being performed after said setting of the spacer at the support shaft; and removing the spacer, said removing of the spacer being performed after said assembling of the rocking body to the liquid container.

2. The manufacturing method of the liquid container according to claim 1, further comprising the step of:

forming the support shaft made of a material having a lower melting point than the rocking body.

3. The manufacturing method of the liquid container according to claim 1, wherein the rocking body includes:

a float unit that displaces a position depending on an amount of the liquid contained in the liquid container; and a detection unit arranged so as to move corresponding to a position of the float unit and enable a position to be detected from an outside of the liquid container.

4. The manufacturing method of the liquid container according to claim 3, wherein a remaining amount of the liquid in the liquid container can be detected based on information related to positioning of the detection unit.

5. The manufacturing method of the liquid container according to claim 3, wherein the liquid container has a support post that limits a movement of the float unit.

6. The manufacturing method of the liquid container according to claim 1, wherein a part of a portion containing the liquid in the liquid container is formed of a flexible film.

7. The manufacturing method of the liquid container according to claim 6, further comprising the step of welding the support shaft and the film.

8. The manufacturing method of the liquid container according to claim 1, wherein the support shaft is formed at a part of a member forming an outer shape of the liquid container.

9. The manufacturing method of the liquid container according to claim 1, wherein the support shaft is formed in the rocking body.

10. The manufacturing method of the liquid container according to claim 1, wherein a metal block is heated and pressed against the support shaft, thereby melting the support shaft.

11. The manufacturing method of the liquid container according to claim 1, wherein friction heat is generated at the tip of the support shaft to melt the support shaft.

* * * * *